US005568726A

United States Patent [19]

Yamada et al.

[11] Patent Number: 5,568,726

[45] Date of Patent: Oct. 29, 1996

[54] EXHAUST PIPE STRUCTURE FOR A MOTORCYCLE

[75] Inventors: Hajime Yamada; Ryoji Nakajima, both of Saitama, Japan

[73] Assignee: Honda Giken Kogyo Kabushiki Kaisha, Tokyo, Japan

[21] Appl. No.: 473,968

[22] Filed: Jun. 7, 1995

[30] Foreign Application Priority Data

Jul. 13, 1994 [JP] Japan ..... 6-161504

[51] Int. Cl.[6] ..... F01N 7/10

[52] U.S. Cl. ..... 60/323; 60/313; 180/219; 180/309

[58] Field of Search ..... 60/312, 313, 323, 60/299, 298, 272; 180/309, 219

[56] References Cited

U.S. PATENT DOCUMENTS 4,809,800 3/1989 Suzuki ..... 60/312
5,271,477 12/1993 Gekka ..... 180/309
5,271,480 12/1993 Takegami ..... 180/219

FOREIGN PATENT DOCUMENTS 148915 11/1980 Japan ..... 60/272
63-87214 6/1988 Japan .

*Primary Examiner*—Douglas Hart
*Attorney, Agent, or Firm*—Birch, Stewart, Kolasch & Birch, LLP

[57] ABSTRACT

To provide an exhaust pipe structure capable of arranging a plurality of exhaust pipes in a restricted space inside a cover and suppressing the discoloring of the cover due to an increase in the temperature of the cover. Each of a plurality of exhaust pipes introduced from each cylinder of a multi-cylinder engine includes a double-pipe structure of an outer pipe and an inner pipe. The exhaust pipes pass inside the cover in such a manner that at least one exhaust pipe near the inner side surface of the cover is left as being of the double-pipe structure, and at least each of the remaining exhaust pipes has a portion of a single-pipe structure.

20 Claims, 8 Drawing Sheets

EXHAUST PIPE STRUCTURE FOR A MOTORCYCLE

BACKGROUND OF THE INVENTION

1. Field of the Invention

The present invention relates to an exhaust pipe structure for a motorcycle, and particularly to the structure and arrangement of exhaust pipes extending from each cylinder of an engine.

2. Description of Background Art

In a general exhaust pipe structure of a motorcycle, exhaust pipes extend from each cylinder of an engine. A muffler is connected to the downstream ends of the exhaust pipes on each side, whereby exhaust gas disposed within the muffler is discharged from a tail pipe mounted on the rear end of the muffler.

The temperature of exhaust gas directly after being discharged from the engine is very high. The exhaust pipes exposed to the exhaust gas are likely to be discolored, leading to corrosion from the discolored portion. A technique for solving this problem has been known, for example, as disclosed in Japanese Utility Model Laid-open No. SHO 63-87214, wherein each exhaust pipe has a double-pipe structure for suppressing an increase in the temperature of an outer pipe.

In a prior art motorcycle, a cover is provided near the collected portion of exhaust pipes on each side, and the exhaust pipes are disposed to pass inside the cover.

The above-described exhaust pipe having the double-pipe structure is increased in its pipe diameter as compared with an exhaust pipe having a single-pipe structure. To arrange a plurality of the exhaust pipes, each having a large diameter, inside the cover, the size of the cover must be enlarged. Thereby, the cover cannot be contained in a specified space.

On the other hand, the exhaust pipe having a single-pipe structure solves the problem in terms of space. However, there occurs a disadvantage in that the exhaust pipes are discolored by heat and the cover is also discolored by the heat of the exhaust pipes.

SUMMARY AND OBJECTS OF THE INVENTION

To solve the above problem, according to the present invention, an exhaust pipe structure for a motorcycle is provided in which exhaust pipes each having a double-pipe structure extend from each cylinder of a multicylinder engine and the exhaust pipes pass inside covers. A plurality of the exhaust pipes are disposed inside each of the covers. At least one exhaust pipe the inner side surface of the cover is provided as being of the double-pipe structure and each of the remaining ones has a portion of a single-pipe structure.

The exhaust pipe remaining as the double-pipe structure may be disposed on the outermost side.

A plurality of exhaust pipes extend from each cylinder of an engine are collected for each side, and are connected to the front end portion of a muffler. In this case, since part of the collected exhaust pipes are of a single-pipe structure, the exhaust pipes can be collected in a narrow space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
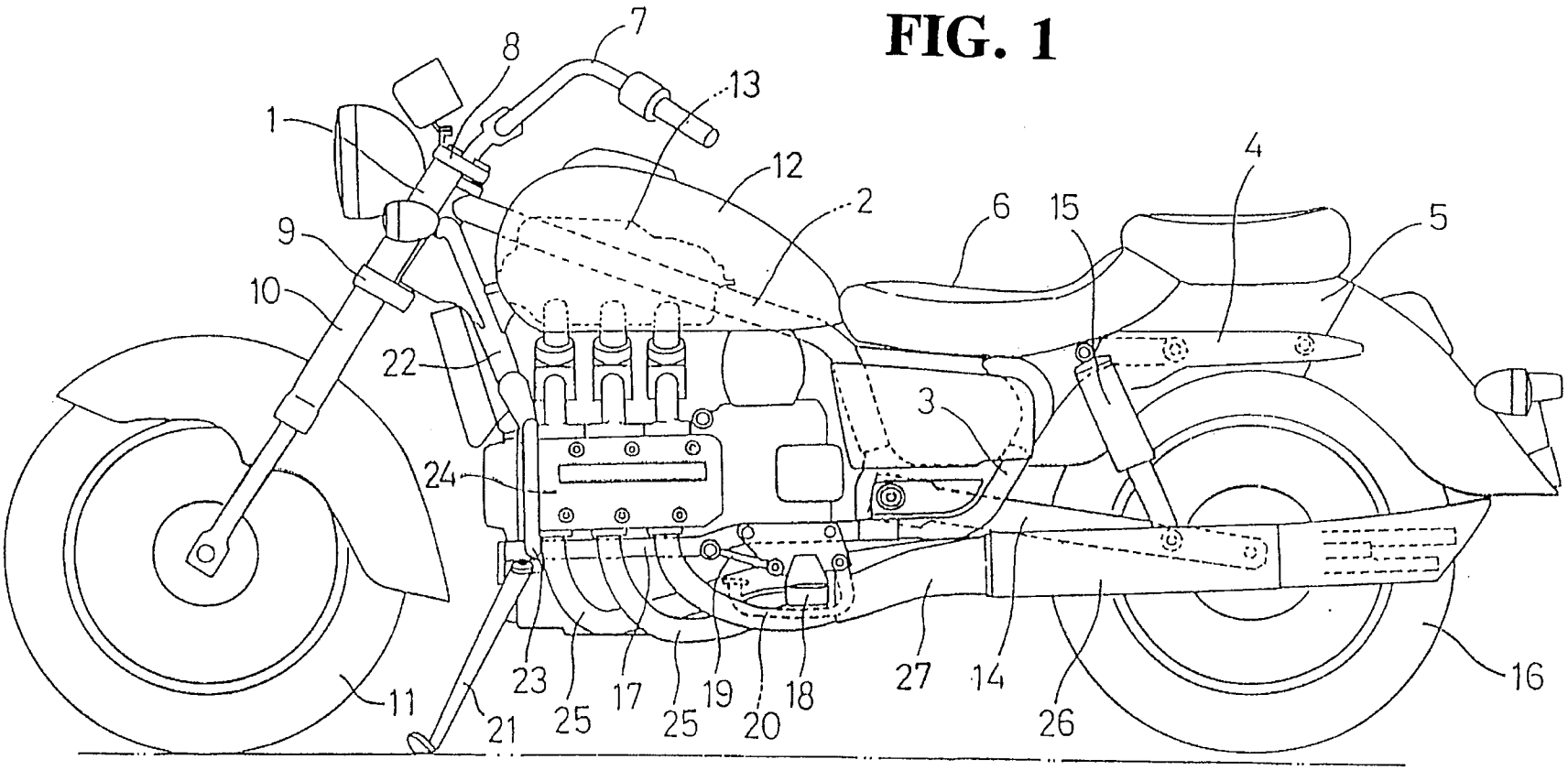
FIG. 1 is a side view showing the whole construction of a motorcycle to which an exhaust pipe structure of the present invention is applied.
Figure 2:
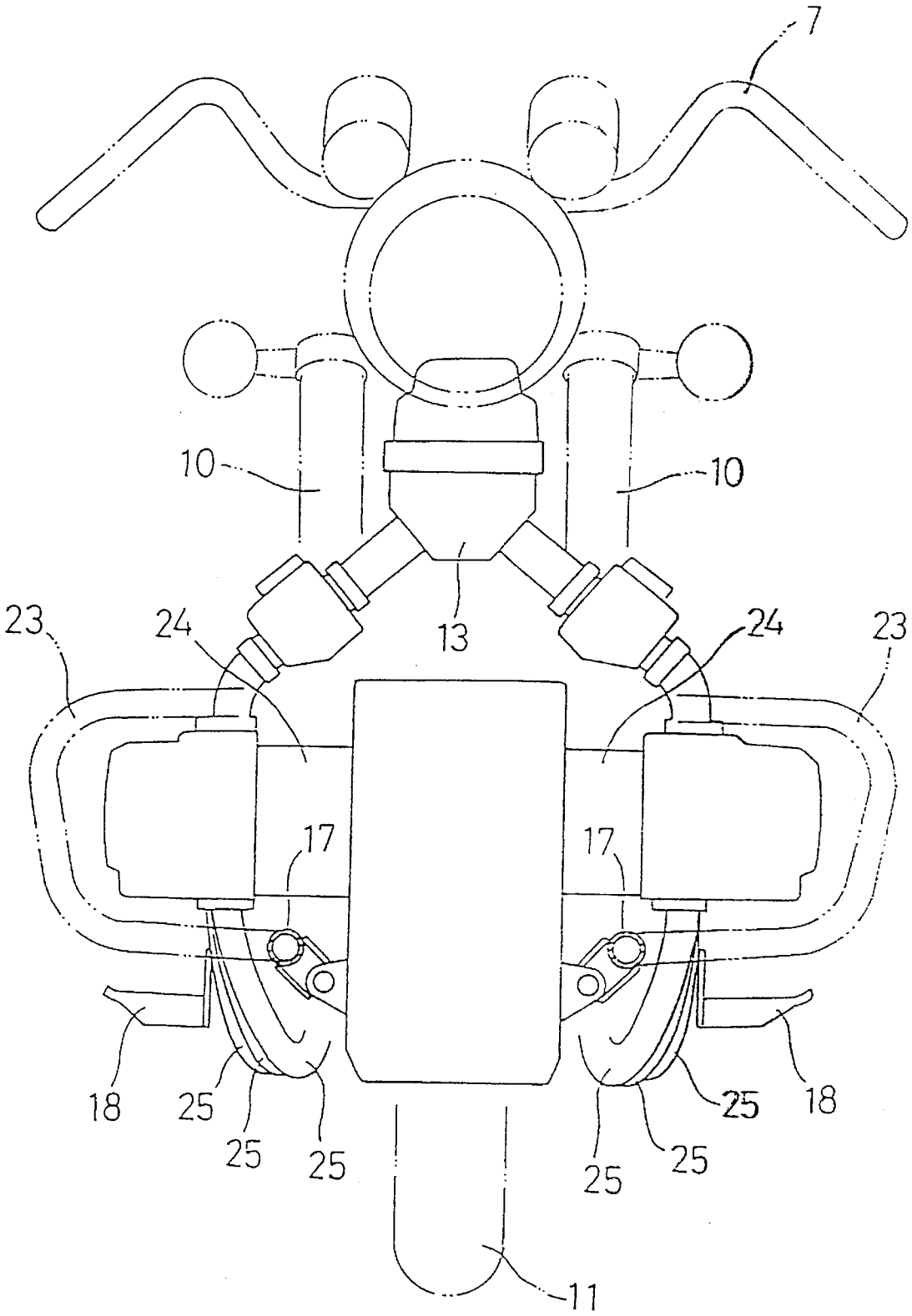
FIG. 2 is a front view of the motorcycle.
Figure 3:
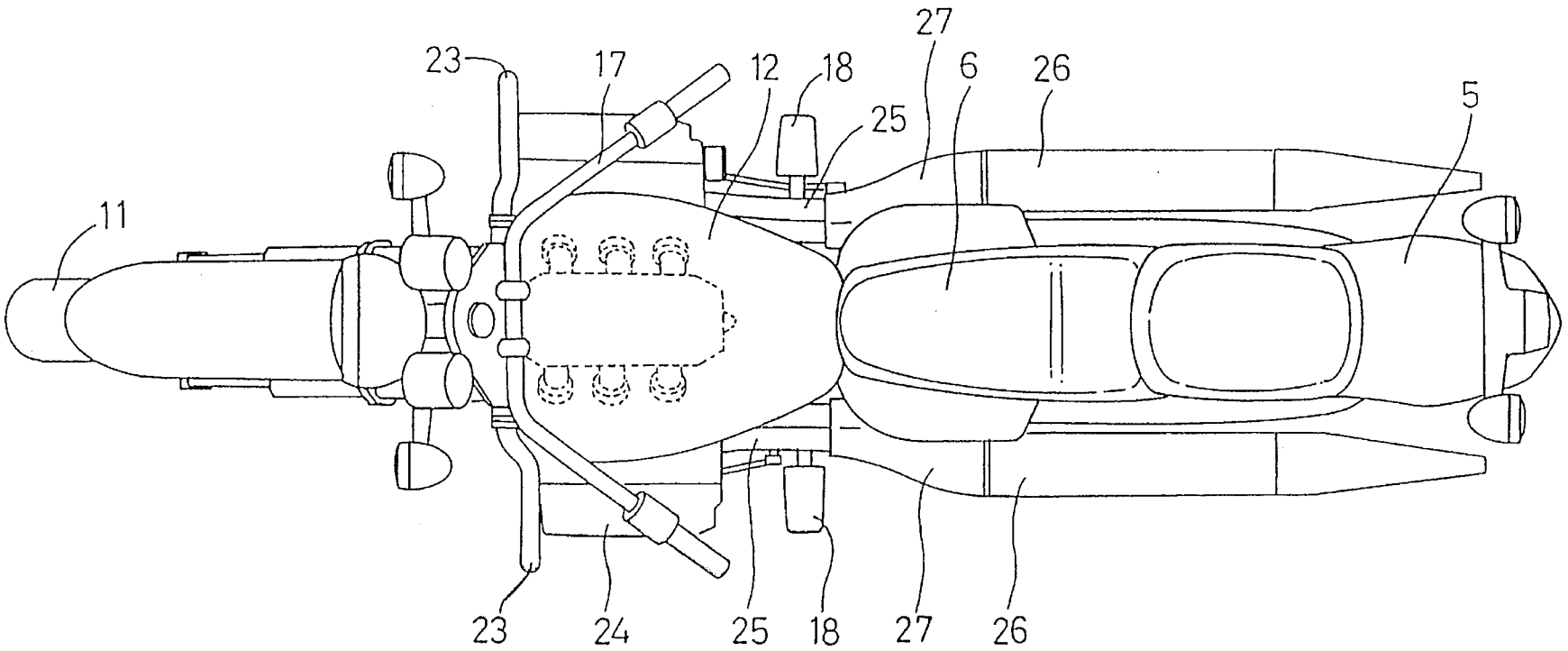
FIG. 3 is a plan view of the motorcycle.

Hereinafter, one embodiment of the present invention will be described with reference to the accompanying drawings. FIG. 1 is a side view showing the entire construction of a motorcycle to which an exhaust pipe structure of the present invention is applied. FIG. 2 is a front view of the motorcycle. FIG. 3 is a plan view of the motorcycle. In the motorcycle shown in FIGS. 1–3, main frames 2 extend obliquely, rearwardly and downwardly from a head pipe 1. Rear frames 3 and seat rails 4 extend obliquely, rearwardly and upwardly from the lower ends of the main frames 2. A rear fender 5 is mounted on the rear frames 3 and the seat rails 4. A seat 6 is supported on the rear fender 5.

A steering shaft rotatable by a handle 7 is inserted in the head pipe 1. The steering shaft includes an upper bridge 8 mounted at the upper end and a lower bridge 9 mounted on the lower end. The upper half portions of a pair of right and left front fork portions 10 are held between the upper bridge 8 and the lower bridge 9. The shaft of a front wheel 11 is supported at the lower ends of a pair of the right and left front fork portions 10.

A fuel tank 12 is mounted in such a manner as to stride over the main frames 2. An air cleaner 13 is disposed under the fuel tank 12. The front ends of swing arms 14 are turnably supported at the lower ends of the main frames 2. A damper 15 is provided between the intermediate portion of the swing arm 14 and the rear frame 3. The shaft of a rear wheel 16 is supported at the rear ends of the swing arms 14.

Sub-frames 17 extend forwardly from the lower ends of the main frames 2, and a step 18, change lever 19, brake pedal 20, stand 21 and the like are supported on the sub-frame 17 by way of brackets.

Down-frames 22 are suspended downwardly from the head pipe 1. An engine guard pipe 23, which extends sidewardly as illustrated in the front view, is mounted between the lower end of the down-frame 22 and the front end of the sub-frame 17. A horizontal six-cylinder engine 24 is mounted in a space surrounded by the main frames 2, sub-frames 17, down-frames 22 and engine guard pipes 23.

Three pieces of exhaust pipes 25 are introduced from each cylinder of the engine 24 for each side, and a muffler 26 is connected to the downstream ends of the exhaust pipes 25. A cover 27 is provided outside the connecting portion between the muffler 26 and the exhaust pipes 25.

Figure 4:
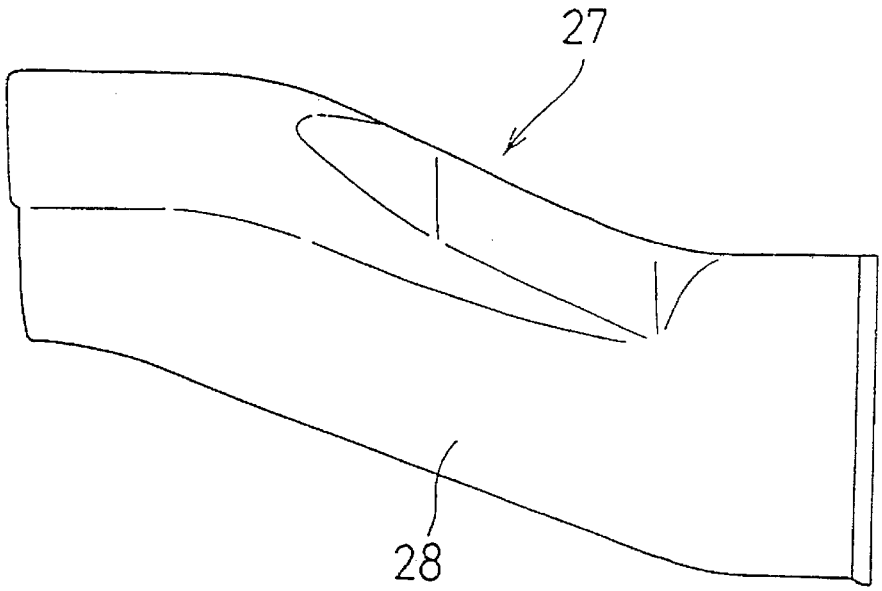
FIG. 4 is a plan view of a cover.
Figure 5:
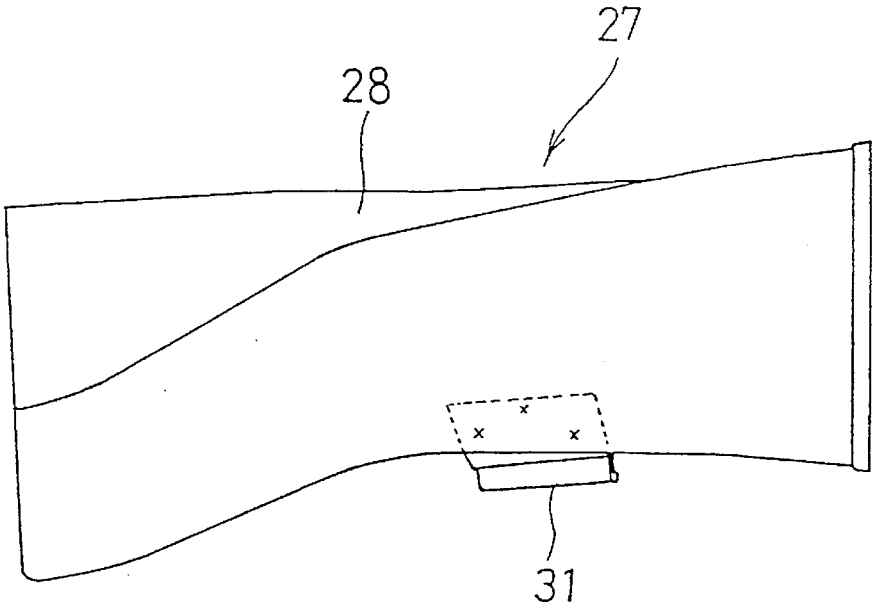
FIG. 5 is a side view of a cover.
Figure 6:
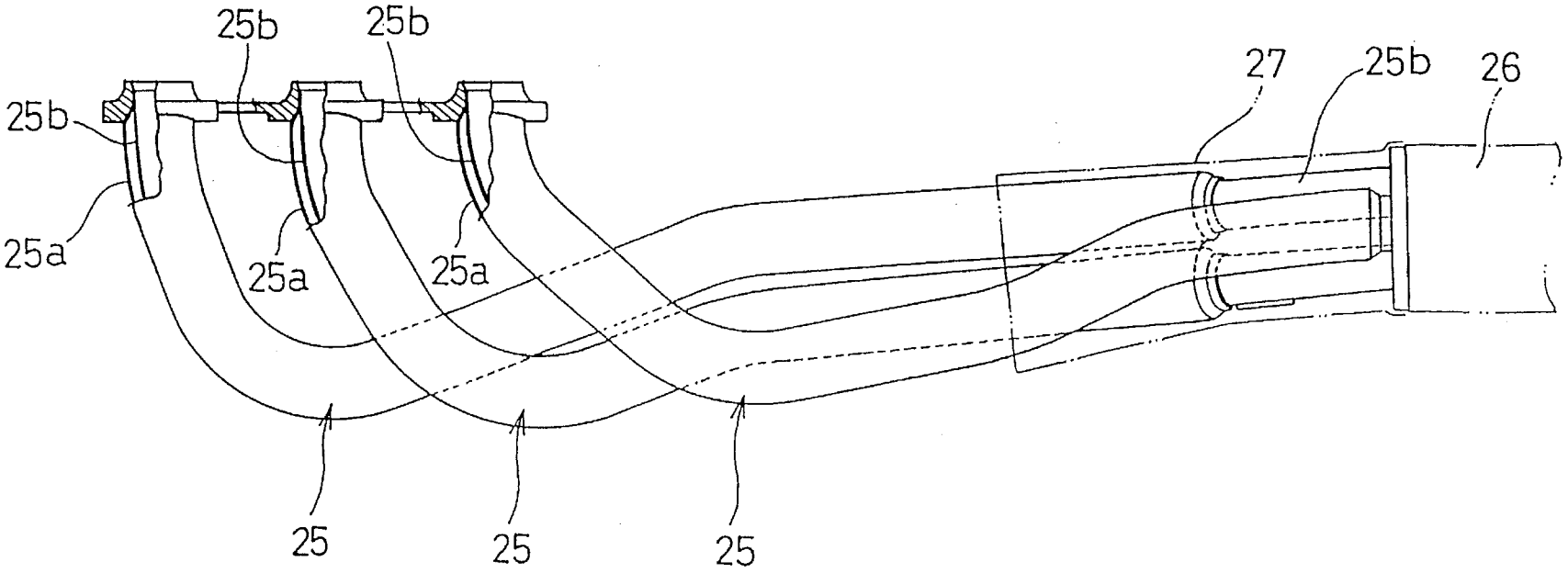
FIG. 6 is a left side view of an exhaust pipe group extending from an engine.
Figure 7:
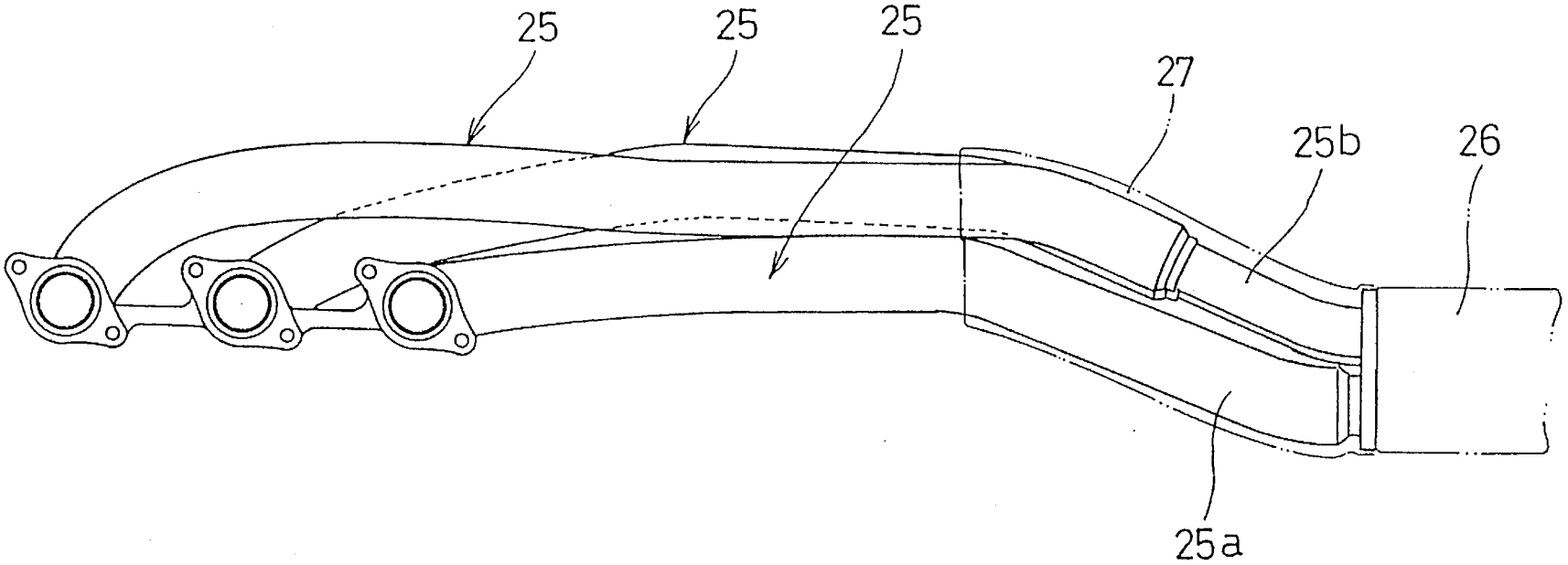
FIG. 7 is a plan view of the exhaust pipe group.
Figure 8:
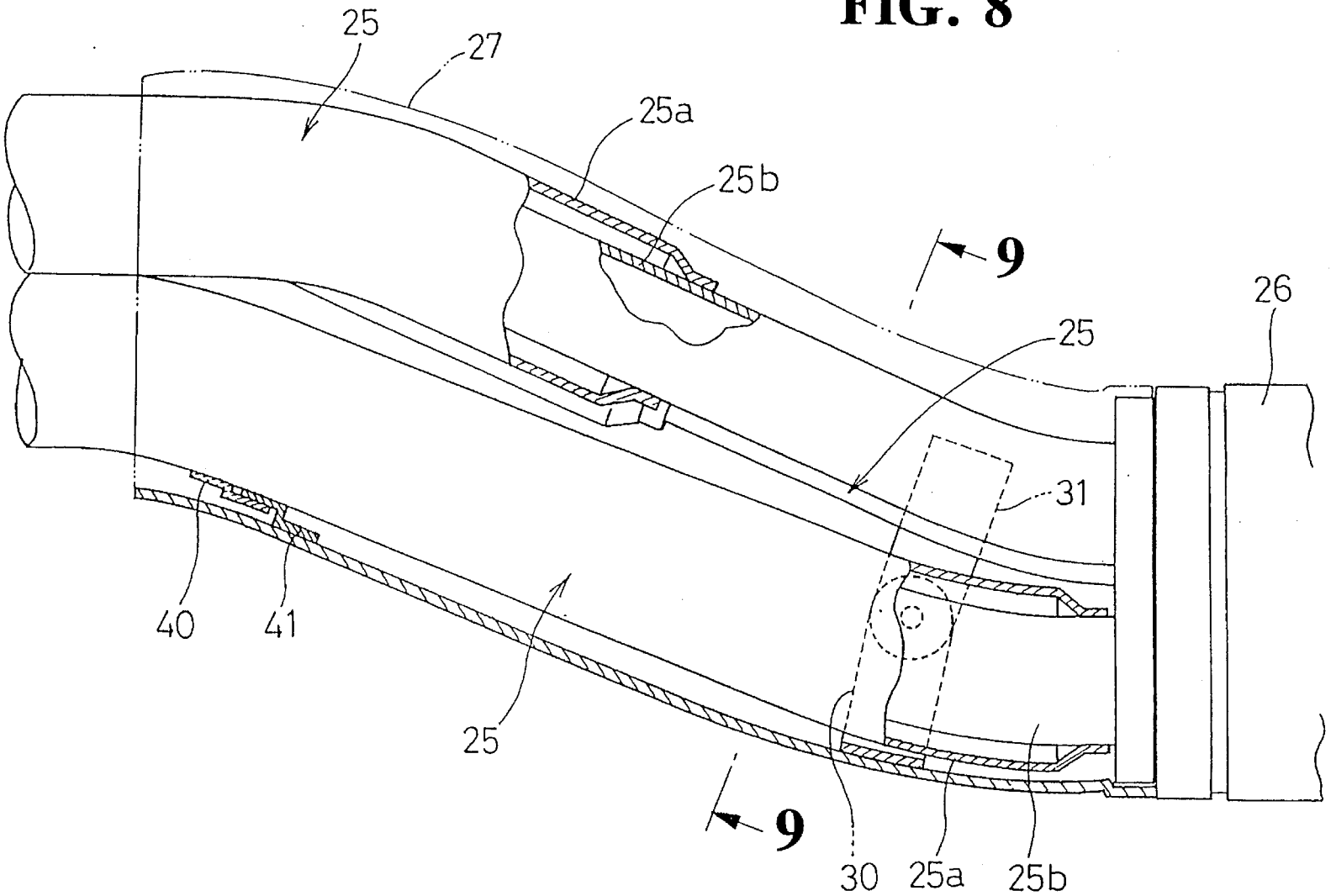
FIG. 8 is an enlarged sectional plan view showing an essential portion of the exhaust pipe group.
Figure 9:
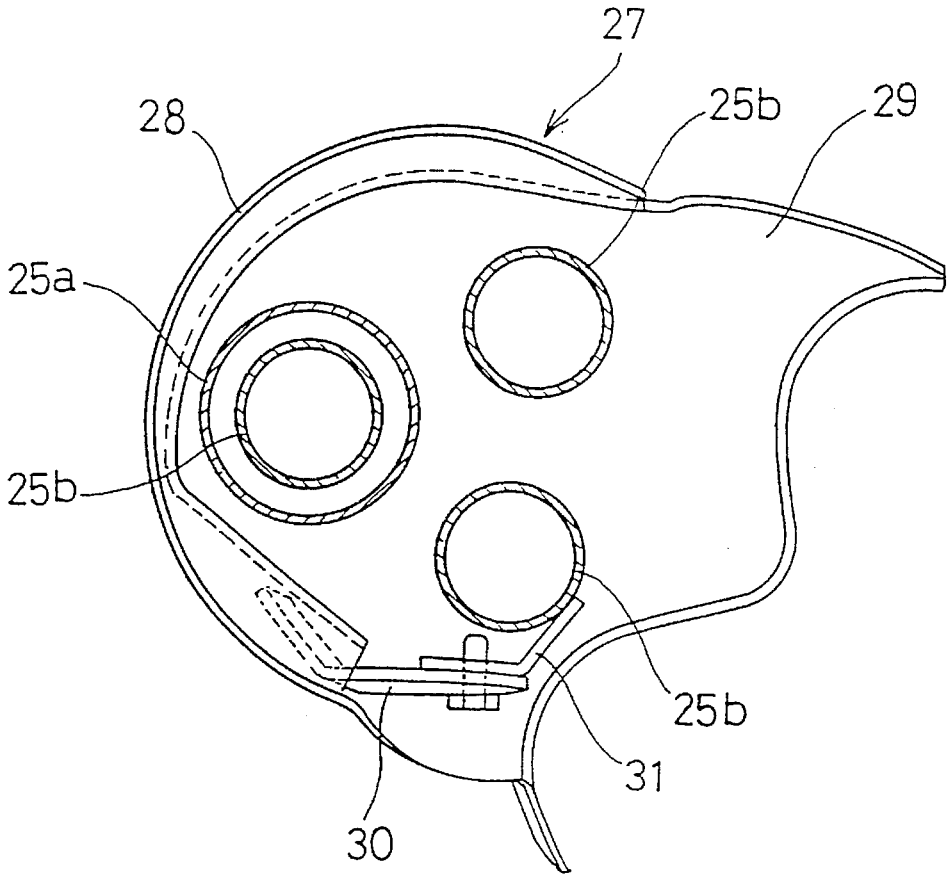
FIG. 9 is a sectional view taken along line 9—9 of FIG. 8.

The cover 27, provided outside the connecting portion between the exhaust pipes 25, will be described in detail with reference to FIGS. 4 to 9. FIG. 4 is a plan view. FIG. 5 is a side view of the cover. FIG. 6 is a left side view of an exhaust pipe group extending from the engine. FIG. 7 is a plan view of the exhaust pipe group. FIG. 8 is an enlarged sectional plan view showing an essential portion of the exhaust pipe group. FIG. 9 is a sectional view taken along line 9—9 of FIG. 8.

The cover 27 includes a half cylinder portion 28 for covering the outside of the exhaust pipe group as shown in FIGS. 4, 5, 9, and an end plate 29 through which the exhaust pipes 25 pass.

Each exhaust pipe 25 has a double-pipe structure of an outer pipe 25*a* and an inner pipe 25*b*. A plurality of holes may be formed in the inner pipe 25*b*.

Three pieces of the exhaust pipes 25 for each side are gradually collected as they extend from the upstream side to the downstream side and pass inside the cover 27, and are thereafter connected to the muffler 26. Of the three exhaust pipes 25 positioned inside the cover 27, one exhaust pipe positioned on the outermost side and near the cover 27 remains as being of the double-pipe structure until being connected to the muffler 26. Each of the remaining ones, two pieces, is so constructed that the downstream half side of the portion covered with the cover 27 is not provided with the outer tube 25*a*. The other exhaust pipes are of a single tube structure composed of only the inner pipe 25*b*. Three pieces of the exhaust pipes are thus effectively arranged in the restricted space.

Of the three exhaust pipes 25, the one positioned on the outermost side is fixed on the cover 27 by a method wherein hooks 40, 41 provided thereon are engaged with the cover 27. The exhaust pipes positioned on the inner side are fixed to the cover 27 by way of stays 30, 31.

Figure 10:
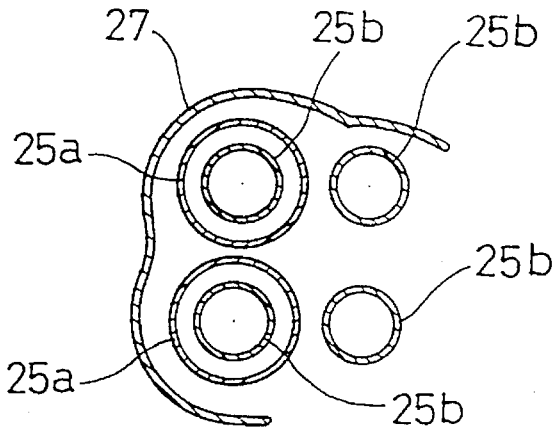
FIG. 10 is a sectional view showing another embodiment.

FIG. 10 is a sectional view showing another embodiment. In this embodiment, four exhaust pipes are provided for each side. Two of the exhaust pipes of the two piece construction are positioned on the outer side adjacent to the cover 27. Each of the two pieces positioned on the inner side has a single-pipe construction. In this way, like the above-described embodiment, a plurality of exhaust pipes can be contained in the restricted space, and the heating of the cover can be suppressed.

As described above, in an exhaust pipe structure of a motorcycle of the present invention, a plurality of exhaust pipes, each having a double-pipe structure, introduced from each cylinder of a multi-cylinder engine are disposed to pass inside a cover in such a manner that at least one exhaust pipe near the inner side surface of the cover is left as being of the double-pipe structure. Each of the remaining exhaust pipes is of a single-pipe structure. Accordingly, all of the exhaust pipes can be contained inside the cover without enlargement of the size of the cover, and an increase in the surface temperature of the cover can be suppressed, to thereby effectively prevent the discoloring of the cover.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cover for an exhaust pipe construction for a motorcycle comprising:

a plurality of exhaust pipes each having an inner pipe and an outer pipe forming a double-pipe construction extending for a predetermined distance, individually, from each cylinder of a multi-cylinder engine;

a cover mounted at a portion of a motorcycle adjacent to an area where the feet of an operator are disposed;

said plurality of exhaust pipes extending inside said covers; and at least one of said exhaust pipes extending inside said cover continues as a double-pipe construction and each of the remaining exhaust pipes disposed inside said cover continues as a single-pipe construction.

2. The cover for the exhaust pipe construction for a motorcycle according to claim 1, wherein said at least one exhaust pipe of the double-pipe construction is disposed on the outermost side.

3. The cover for the exhaust pipe construction for a motorcycle according to claim 1, wherein three exhaust pipes are disposed inside said cover.

4. The cover for the exhaust pipe construction for a motorcycle according to claim 1, wherein said cover includes a half cylinder portion for covering the exhaust pipes and an end plate through which said exhaust pipes extend.

5. The cover for the exhaust pipe construction for a motorcycle according to claim 1, wherein said inner pipe of said double-pipe construction includes a plurality of holes for communicating exhaust from said inner pipe to said outer pipe.

6. The cover for the exhaust pipe construction for a motorcycle according to claim 1, and further including a first hook secured to said at least one exhaust pipe being of the double-pipe construction and a second hook secured to an inner wall of said cover, said first and second hooks being engaged with each other for securing said at least one exhaust pipe being of the double-pipe construction to said inner wall of said cover.

7. The cover for the exhaust pipe construction for a motorcycle according to claim 1, and further including a first stay secured to each of the remaining exhaust pipes being of the single-pipe construction and a second stay secured to an inner wall of said cover, said first and second stays being engaged with each other for securing each of said remaining exhaust pipes being of the single-pipe construction to said inner wall of said cover.

8. The cover for the exhaust pipe construction for a motorcycle according to claim 1, wherein said exhaust pipe being of the double-pipe construction and being disposed adjacent to said cover prevents hot exhaust gas from discoloring said cover.

9. The cover for the exhaust pipe construction for a motorcycle according to claim 1, wherein four exhaust pipes are disposed inside said cover.

10. The cover for the exhaust pipe construction for a motorcycle according to claim 9, wherein two of said exhaust pipes extending inside said cover are of the double-pipe construction and the remaining two are of the single-pipe construction.

11. A cover for an exhaust pipe for a motorcycle comprising:

a housing including an interior surface defining a space disposed therein;

a plurality of exhaust pipes each having an inner pipe and an outer pipe forming a double-pipe construction, each of said double-pipe construction exhaust pipes extending for a predetermined distance, respectively;

said plurality of exhaust pipes extending inside said covers; and at least one of said exhaust pipes extending inside said cover continues as a double-pipe construction and each of the remaining exhaust pipes disposed inside said cover continues as a single-pipe construction.

12. The cover for the exhaust pipe construction for a motorcycle according to claim 11, wherein said at least one exhaust pipe of the double-pipe construction is disposed on the outermost side of said cover.

13. The cover for the exhaust pipe construction for a motorcycle according to claim 11, wherein three exhaust pipes are disposed inside said cover.

14. The cover for the exhaust pipe construction for a motorcycle according to claim 11, wherein said housing includes a half cylinder portion for covering the exhaust pipes and an end plate through which said exhaust pipes extend.

15. The cover for the exhaust pipe construction for a motorcycle according to claim 11, wherein said inner pipe of said double-pipe construction includes a plurality of holes for communicating exhaust from said inner pipe to said outer pipe.

16. The cover for the exhaust pipe construction for a motorcycle according to claim 11, and further including a first hook secured to said at least one exhaust pipe being of the double-pipe construction and a second hook secured to an inner wall of said housing, said first and second hooks being engaged with each other for securing said at least one exhaust pipe being of the double-pipe construction to said inner wall of said housing.

17. The cover for the exhaust pipe construction for a motorcycle according to claim 11, and further including a first stay secured to each of the remaining exhaust pipes being of the single-pipe construction and a second stay secured to an inner wall of said housing, said first and second stays being engaged with each other for securing each of said remaining exhaust pipes being of the single-pipe construction to said inner wall of said housing.

18. The cover for the exhaust pipe construction for a motorcycle according to claim 11, wherein said exhaust pipe being of the double-pipe construction and being disposed adjacent to said cover prevents hot exhaust gas from discoloring said housing.

19. The cover for the exhaust pipe construction for a motorcycle according to claim 11, wherein four exhaust pipes are disposed inside said cover.

20. The cover for the exhaust pipe construction for a motorcycle according to claim 19, wherein two of said exhaust pipes extending inside said cover are of the double-pipe construction and the remaining two are of the single-pipe construction.

* * * * *